United States Patent [19]

Lindström

[11] 4,219,056

[45] * Aug. 26, 1980

[54] METHOD AND APPARATUS FOR SAWING TIMBER

[75] Inventor: Nils E. Lindström, Karlstad, Sweden

[73] Assignee: Vänerskog AB, Karlstad, Sweden

[ * ] Notice: The portion of the term of this patent subsequent to May 26, 1995, has been disclaimed.

[21] Appl. No.: 657,641

[22] Filed: Feb. 12, 1976

[30] Foreign Application Priority Data

Feb. 19, 1975 [SE] Sweden ..... 7501857

[51] Int. Cl.[2] ..... B27B 1/00

[52] U.S. Cl. ..... 144/3 P; 83/176; 83/808; 144/39; 144/41; 144/312; 144/326 R

[58] Field of Search ..... 144/3 R, 1 R, 2 R, 2 D, 144/41, 37, 39, 3 P, 134 R, 114, 242 R, 242 D, 309 R, 312, 321, 322, 323, 326 R; 83/102, 176, 732, 808

[56] References Cited

U.S. PATENT DOCUMENTS

| | | | |
|---|---|---|---|
| 3,344,826 | 10/1967 | Mitten | 144/3 R |
| 3,750,727 | 8/1973 | Ord | 144/3 P X |
| 3,884,281 | 5/1975 | Pepse | 144/326 R |
| 3,920,058 | 11/1975 | Walker | 144/312 |
| 3,934,630 | 1/1976 | Cockle | 144/312 X |

*Primary Examiner*—W. Donald Bray

*Attorney, Agent, or Firm*—James Creighton Wray

[57] ABSTRACT

The invention relates to a method and apparatus for sawing logs having a curved longitudinal length to obtain maximum recovery of sawed planks therefrom. There are provided several sawing stations for handling the curved log including edge sawing, heart split sawing along the curved center line of the log and perpendicular to the edge sawed surfaces to produce two sections having curved center cut surfaces, and dividing sawing each section parallel to the center cut surface.

15 Claims, 15 Drawing Figures

Figure 3:
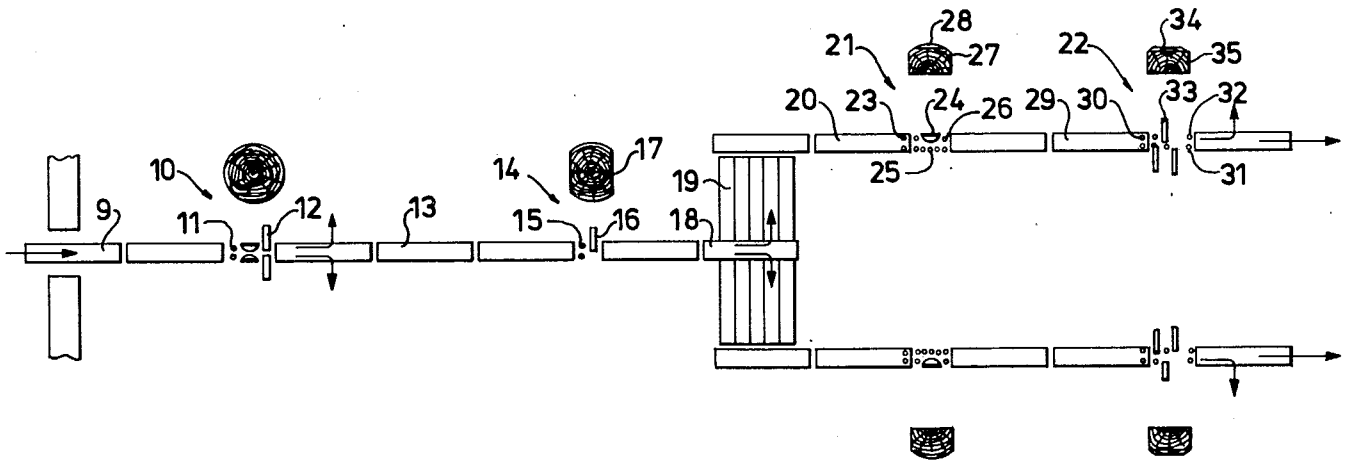

Fig. 1
PRIOR ART
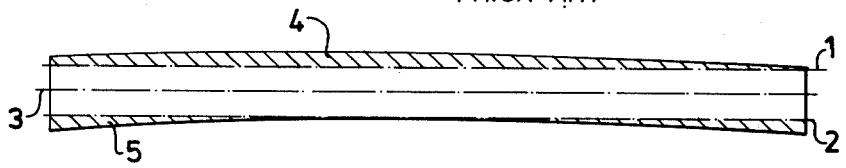
Fig. 2
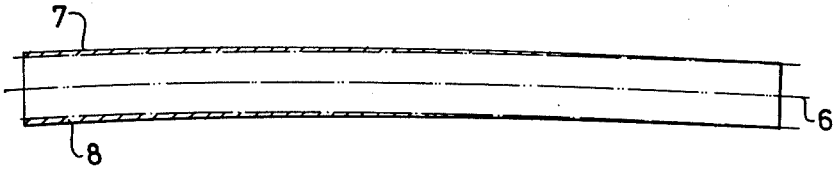
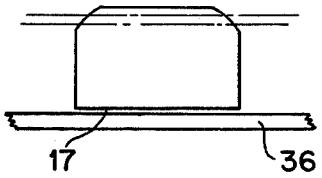
Fig. 4A
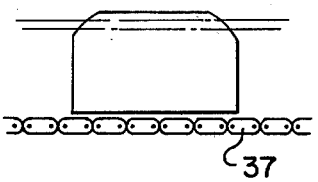
Fig. 4B
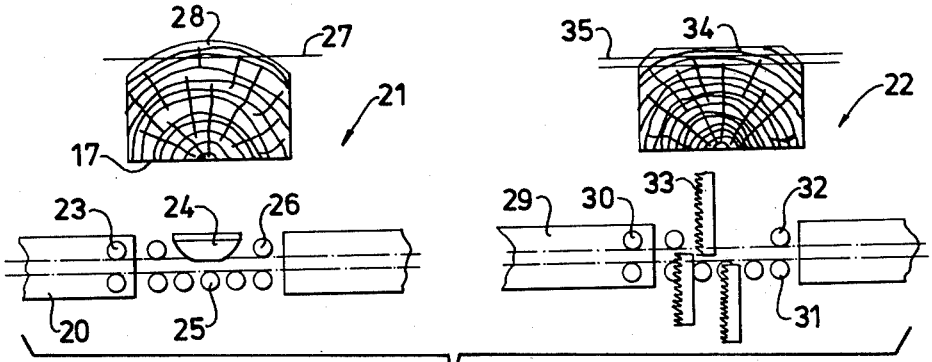
Fig. 4

FIG. 5
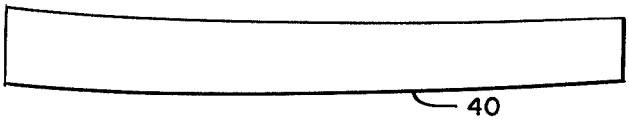
FIG. 6
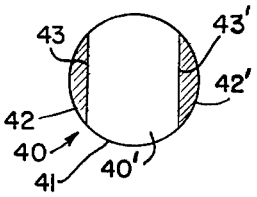
FIG. 7
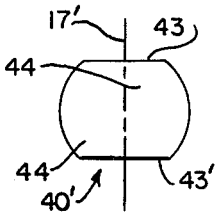
FIG. 8
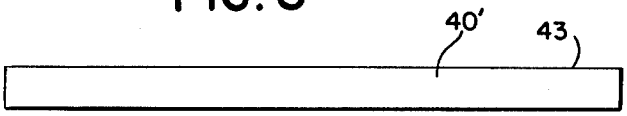
FIG. 8A
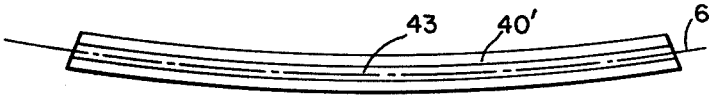
FIG. 9
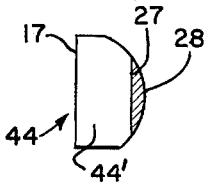
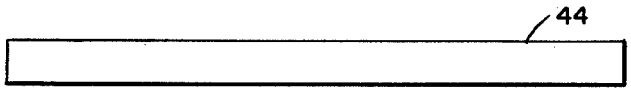
FIG. 10
FIG. 11
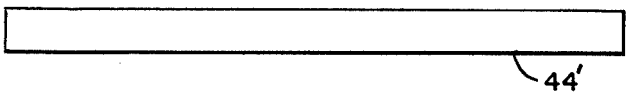
FIG. 13
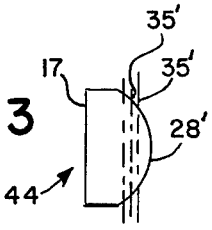
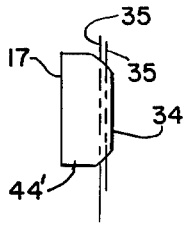
FIG. 12

METHOD AND APPARATUS FOR SAWING TIMBER

The present invention relates to the field of sawing timber, and the invention is especially directed to a method and an apparatus for making use of the log to an optimum for obtaining sawn timber.

A large percentage of the logs which are sawn are more or less curved and when sawing such logs in the conventional way a large amount of waste material is obtained because of the fact that the sawing follows a straight line path and depending on the curvature of the log has as an effect that substantial parts of the log have to be sawn away, which parts can at the best be used for other purposes than for making planks and boards.

Basis of the invention is the idea to substantially follow the same curvature as that of the log when sawing it or at least some part thereof so as to make use of the log for obtaining plank and board as near an optimum as possible. According to the invention the sawing takes place in several successive steps whereby in the first step the log is placed with the convexly curved part thereof turned down on a conveyer and in a straight line path is moved through a straight line edger, whereupon the edge sawn log is rotated and is placed on the conveyer lying on one of its plain sawn sides and is moved through a center split machine in which the log is heart split sawn following a path which substantially corresponds to the curvature of the log, and thereafter the log may be subjected to block reducing sawing and dividing sawing.

The two halves of the log which are obtained when heart split sawing the log normally have a curved form, and in order to give the final cut plank an even thickness the following steps of block reducing sawing and the dividing sawing must take place parallel to the heart split sawing cut. According to a particular characteristic of the invention this is accomplished in that the log during the feeding thereof through the block reducing saw and the dividing saw is forced against a planing path which provides a straightening of the curved form of the log and in which the sawing follows a straight line path. After the dividing sawing the final cut plank regains its curved form, but when drying and conditioning the sawn timber planks in piles the sawn curved timber is straightened so that the finally treated plank becomes practically completely straight.

Further characteristics of the invention will be evident from the following detailed description in which reference will be made to the accompanying drawings. In the drawings FIG. 1 diagrammatically illustrates the method of sawing curved timber in the conventional way and what waste material is obtained during such sawing.

In FIG. 2 is in a corresponding way illustrated the sawing of timber according to the invention and what reduction of the amount of waste material is obtained at such sawing.

FIG. 3 diagrammatically shows an apparatus for performing the method according to the invention when sawing timber and especially sawing curved timber.

FIG. 4 shows in a greater scale than that of FIG. 3 a block reducing sawing apparatus and a dividing sawing apparatus according to the invention.

FIGS. 4A and 4B schematically show mat and movable chain planing paths, respectively.

FIGS. 5 through 13 show steps in the process of the present invention.

Sawing of timber normally takes place in several successive steps including an edge sawing step, in which one, two or more cuts are sawn diametrically opposite each other on both sides of the log so as to give the log two plain parallel opposite surfaces, and in a following step the log is then divided in two substantially like parts with a cut extending perpendicularly to the plain parallel surfaces. Each of the said halves or blocks thereby obtained are then subjected to a block reducing step in which the remaining round surface of the log is sawn or milled away so that the said surface becomes parallel with the cut surface through the center of the log, and thereupon the log is subjected to dividing sawing, whereby the log is edge sawn so that all remaining rounded edges of the block are removed and so that the final product thereby obtained is a block having rectangular cross section. The slabs obtained when edge sawing, dividing sawing and if necessary block reducing the log are separately sawn to boards of suitable length and dimension.

Most logs have somewhat of a curve as formed and when feeding the log into the saw the convexly curved or bow formed part thereof is generally turned down so that the edge sawing is made parallel with the straight line extension of the log. After the edge sawing the log is rotated so as to lie on one of the flat parallel sides obtained at the edge sawing to the effect that the log shows its curved form in the horizontal plane.

In conventional sawing which is illustrated in FIG. 1 the log is heart split sawn, block reducing sawn and dividing sawn by means of straight line cuts extending along a straight line feeding path whereby it is tried to make use of the largest possible part of the log. Since the log both tapers towards the top end thereof (the right hand side of the figure) and is also curved it is at the maximum possible to use the part thereof defined between the lines 1 and 2, whereby the heart split sawing follows the line 3. On both sides of the lines 1 and 2 there are portions 4 and 5 which at the best can be used for sawing boards but which are often considered waste material. It is the aim of this invention to gain as large a plank as possible out of the log, and the portions 4 and 5 represent an uneconomical recovery of the log.

Basis of the invention is the idea to make use of the log at an optimum by sawing the log corresponding to the curvature which the log exhibits in the horizontal plane after the above mentioned edge sawing. By following the curvature of the log in this way it is possible to divide the log in two substantially like large halves by a split sawing cut 6 of FIG. 2, and as evident from FIG. 2 a waste material portion 7 and 8 respectively is obtained on opposite sides of the log which portions are substantially reduced to the unavoidable waste material depending on the tapering of the log towards the top end.

Referring now to FIG. 3 there is shown a complete saw mill in which the timber enters through a saw mill intake 9 and is turned so that the curved form if any of the log is turned down whereupon the log is edge sawn in an edger station 10. The log is moved through the edger by means of feeder rollers 11 which feed the log through two or any other suitable even number of saws which saw off one or several slabs of two opposite sides of the log so as to give two flat parallel sides to the log. The saws 12 may be frame saws, circular saws, band saws or any other suitable type of saws, and a block reducing device may be provided at the feeder side of the said saws. After having passed the edger station the log is rotated so as to be placed lying on one of the flat parallel sides and by means of a conveyer 13 it is moved into a centre or heart split sawing station 14 by means of feeder rollers 15. The heart split sawing station is formed with means (not shown) for laterally moving the log to one side or the other so that the split cut along the entire log may be brought to follow the centre thereof, whereby the heart split cut surface 17 obtains a curvature which practically exactly corresponds to the curvature of the log. The heart split sawing of the log following the center thereof can alternatively be done by the use of laterally movable saws (not shown). Thus, the laterally movable saws are laterally moved to follow the curved longitudinal length of the log during movement of the log through the heart split sawing station.

By the heart split sawing, the log is divided in two like large blocks which from a conveyer 18 each are fed to another conveyer 20 over a conveyer 19 extending at an angle to the first mentioned conveyer 18, whereby each block is moved into a block reducing sawing station 21 and from the said block reducing station to a dividing sawing station 22. The said last mentioned stations are shown in a greater scale in FIG. 4.

The block reducing station 21 is formed with a couple of feeder rollers 23 which feed the log past a block reducing tool 24 which may be a saw or a mill or similar. The side of the block reducing station corresponding to the heart split cut surface 17 of the log is formed with a planing path which is illustrated comprising a number of rollers 25 against which the log is forced by opposite rollers 26 and the block reducing tool 24. The roller 26 and the block reducing tools 24 are forcing the log toward the rollers 25 with such a force that the curve form of the log is straightened whether the curvature is turned towards or from the planing path. The block reducing tool 24 provides a milling of the side of the log which is opposite the heart split cut surface 17 by a cut 27 which is parallel to the heart split cut surface 17. The portion 28 of the log which is milled or sawn away is in the form of slab or cellulose chip withdrawn for other use.

From the block reducing station 21 the log is by a conveyor 29 moved into the dividing sawing station 22 through which the log is fed by a system of feeder rollers 30. The dividing station is formed with a planing path of the same type as in the station 21, in this case shown in the form of a number of rollers 31 extending on line with each other and corresponding pressure rollers 32. Preferably the dividing saw station is formed with several saws 33 which are adjustable in the lateral direction and by means of which one or more slabs 34 may be sawn off at the side of the log which is opposite the planing path. The number of cuts 35 which are sawn in the dividing station depend on how large portion 28 is milled away in the block reducing station, and in the illustrated example two slabs are sawn out, whereby the remaining block obtains a quite rectangular cross section form. From the dividing station the slabs which have been sawn off are removed for being edge sawn and cut to boards, and the remaining block which is in this case the final product is moved on for being dried in the usual way. By making the heart split sawing according to the invention with a cut surface 17 corresponding to the curvature of the log and by performing the block reducing sawing and the dividing sawing parallel with the cut surface 17 it has been possible to reduce the waste material at the sawing to a minimum, and in spite of this a final product is obtained which has the same or even higher quality than what has previously been possible to obtain, in particular since it has proved that the block obtained from the dividing sawing station during drying and conditioning straightens itself and gives a very high quality product among other things depending on that the sawing takes place parallel with the wood fibres and that the heart split cutting given a reduced cracking during the drying.

The saws 12, 16 and 33 of the above mentioned saw mill can be frame saws, circular saws or band saws, and the invention is consequently not restricted to any particular type of saw. Alternatively to forming the saw mill as shown in FIG. 3 with two parallel lines for block reducing sawing and dividing sawing it is possible to provide one single line which in turn block reducing saws and dividing saws the split log blocks, and it is also possible to exclude the block reducing station. In the embodiment shown in connection to FIGS. 3 and 4 the dividing sawing station is formed with three saws 33, of which only two are intended to provide the saw cuts 35. It is however obvious, that the third saw if needed may be moved laterally to provide a further saw cut, or that any wanted member of saws may be provided on line after each other in the dividing saw station for sawing the block to planks and boards if wanted.

FIG. 4A shows a plate of metal or a movable mat 36 as a planing path against which the center split surface 17 of a log may be pressed for straightening during cutting. FIG. 4A shows a chain 37 used as a similar planing path.

FIGS. 5 and 6 represent edge sawing in the first step of the process wherein the curved log 40 is placed on one of its curved edges 41, and edge segments 42 and 42' are cut away from the log 40 by vertical cuts so that parallel sides 43 and 43' are obtained on edged log 40'.

The edged log 40' is turned on one of the sides 43' with the other of the sides 43 facing upward as shown in the end elevation of FIG. 7, the side elevation of FIG. 8, and the plan view in FIG. 8A. The log 40' is heart split cut along cut 17' shown in FIG. 7, following the curved center line 6 as shown in FIG. 8A. The center split cutting produces two blocks 44.

In the optional step of block reducing as shown in FIGS. 9 and 10, a segment 28 is removed from block 44 along an edge opposite the center split cut surface 17. That step is accomplished by using a mill or by sawing along cut 27 while the heart split cut surface 17 of block 44 is forced flat against a number of rollers, such as 25 shown in FIG. 3, by pressure rollers such as 26 shown in FIG. 3. The result of that step is reduced block 44'.

As shown in FIGS. 11 and 12, the resulting reduced block 44' is divided into a number of slabs 34 by parallel cuts 35 while forcing the heart split cut surface 17 against a number of aligned rollers, such as rollers 31 shown in FIG. 3 with pressure rollers such as rollers 32 shown in FIG. 3.

FIG. 13 shows the dividing of a block 44 which has skipped the optional block reducing step shown in FIG. 9. Segment 28' is removed by cutting along cut 27'. Saw cuts 35' are similar to saw cuts 35 in FIG. 12.

It is to be understood that the above described method and apparatus is only an illustrating example and that the invention is only defined by the appended claims.

What we claim is:

1. A method for sawing timber which has an overall curved and non-curved longitudinal length comprising edge sawing said timber along opposite sides of said non-curved longitudinal length to produce parallel diametrically opposed edge cut surfaces having said curved longitudinal length therebetween, heart split sawing said edge sawed timber perpendicular to said parallel edge cut surfaces and along the curved center line of said curved longitudinal length to produce two curved edge sawed sections of said timber each having a curved center cut surface, dividing sawing each of said heart split cut sections by at least one saw cut along the longitudinal length of said section parallel to said center cut surface.

2. The method of claim 1, wherein said edge sawed timber is heart split sawed through fixed sawing means, and said timber is moved along said curved center line during said heart split sawing.

3. The method of claim 1, wherein said edge sawed timber is heart split sawed through laterally movable sawing means, and said sawing means are laterally moved to follow said curved longitudinal length during said heart split sawing.

4. The method of claim 1, wherein said edge sawed section is dividing sawed through parallel fixed sawing means, and said curved center cut surface of said section is forced against a plane surface with sufficient force to straighten said curved center cut surface, whereby said dividing sawing follows a straight line path through said parallel fixed saws.

5. The method of claim 1, wherein each of said heart split sections are block reducing sawed prior to said dividing sawing, comprising forcing said curved center cut surface of said heart split section against a plane surface with sufficient force to straighten said curved center cut surface, and block reducing sawing the side of said section opposite said center cut surface to obtain a block reducing cur surface parallel to said center cut surface.

6. An apparatus for sawing timber which has an overall curved and non-curved longitudinal length comprising edge sawing means for sawing said timber along opposite sides of said non-curved longitudinal length to produce parallel diametrically opposed edge cut surfaces, heart split sawing means for sawing said edge sawed timber perpendicular to said parallel edge cut surfaces and along the curved center line of said curved longitudinal length to produce two curved edge sawed sections of said timber each having a curved center cut surface, dividing sawing means for sawing said heart split sections with at least one saw cut along the longitudinal length of said section parallel to said center cut surface.

7. The apparatus of claim 6, wherein said heart split sawing means also comprises means for moving said edge sawed timber laterally, whereby said edge sawed timber can be split sawed along the said curved center line of said curved longitudinal length.

8. The apparatus of claim 6, wherein said dividing sawing means comprises at least one laterally adjustable sawing means, plane surface path means and pressure roller means whereby said heart split sections can be forced with sufficient pressure by said pressure roller means against said plane surface path means to hold them during said dividing sawing.

9. The apparatus of claim 8, wherein said plane surface path means comprises metal plate means.

10. The apparatus of claim 8, wherein said plane surface path means comprises movable mat means.

11. The apparatus of claim 8, wherein said plane surface path means comprises movable chain means.

12. The apparatus of claim 8, wherein said plane surface path means comprises in-line roller means.

13. The apparatus of claim 6, wherein block reducing sawing means are disposed between said heart split sawing means and said dividing sawing means, comprising block reducing sawing means for sawing the side of said heat split section opposite said center cut surface, plane surface path means against which said curved center cut surface can be forced, and pressure roller means for forcing said center cut surface with sufficient force against said path means to straighten said curved center cut surfaces during said block reducing sawing.

14. The apparatus of claim 13, wherein said edge sawing means, heart split sawing means, block reducing sawing means, and dividing sawing means are disposed in path means for continuous sawing treatment of said timber and said means are provided with conveyor means therebetween.

15. The apparatus of claim 14, wherein said path means for continuous treatment of said timber comprises parallel dividing sawing means following said heart split sawing means.

* * * * *